US008919742B2

(12) United States Patent
Williams, Sr. et al.

(10) Patent No.: US 8,919,742 B2
(45) Date of Patent: Dec. 30, 2014

(54) SYSTEM AND FENCE KIT FOR STRENGTHENING A FENCE

(75) Inventors: Peter E. Williams, Sr., Bayport, NY (US); Paul Wesnofske, Greenlawn, NY (US)

(73) Assignee: Eastern Wholesale Fence Co., Inc., Medford, NY (US)

( * ) Notice: Subject to any disclaimer, the term of this patent is extended or adjusted under 35 U.S.C. 154(b) by 718 days.

(21) Appl. No.: 12/879,718

(22) Filed: Sep. 10, 2010

(65) Prior Publication Data

US 2012/0061636 A1 Mar. 15, 2012

(51) Int. Cl.

| | |
|---|---|
| ***E04H 17/14*** | (2006.01) |
| ***E04H 17/16*** | (2006.01) |
| *E04H 17/00* | (2006.01) |

(52) U.S. Cl.

CPC ..... *E04H 17/16* (2013.01); *E04H 2017/1452* (2013.01); *E04H 2017/006* (2013.01)

USPC .... 256/66; 256/65.11; 256/65.12; 256/65.13; 256/65.14

(58) Field of Classification Search

CPC ..... E04H 17/20; E04H 17/1421

USPC ..... 256/19, 65.01, 66, 65.02, 65.11–65.14

See application file for complete search history.

(56) References Cited

U.S. PATENT DOCUMENTS

| | | | | |
|---|---|---|---|---|
| 3,921,960 | A * | 11/1975 | Bright | 256/65.12 |
| 3,955,801 | A * | 5/1976 | Soriero, Jr. | 256/65.13 |
| 4,875,806 | A * | 10/1989 | Lindberg et al. | 405/224 |
| 5,312,089 | A * | 5/1994 | Venegas, Jr. | 256/65.12 |
| 5,402,988 | A | 4/1995 | Eisele | |
| 5,494,261 | A | 2/1996 | Gandara | |
| 5,577,714 | A * | 11/1996 | Venegas, Jr. | 256/65.12 |
| 5,704,188 | A * | 1/1998 | Coulis | 256/65.14 |
| 5,927,857 | A | 7/1999 | Ceroll et al. | |
| 5,938,184 | A * | 8/1999 | DeSouza | 256/65.06 |
| 6,017,019 | A * | 1/2000 | Erwin | 256/65.05 |
| 6,152,428 | A * | 11/2000 | Simioni | 256/24 |
| 6,173,945 | B1 | 1/2001 | Lindsey et al. | |
| 6,213,452 | B1 * | 4/2001 | Pettit et al. | 256/65.14 |
| 6,398,193 | B1 * | 6/2002 | DeSouza | 256/65.06 |
| 6,467,756 | B1 * | 10/2002 | Elsasser | 256/65.14 |
| 6,530,561 | B2 | 3/2003 | Larsen et al. | |
| 7,032,891 | B2 | 4/2006 | Rowley et al. | |
| 7,243,473 | B2 * | 7/2007 | Terrels | 52/843 |
| 7,389,975 | B2 | 6/2008 | Rowley et al. | |
| 7,571,897 | B2 | 8/2009 | Heinz | |
| 7,635,114 | B2 | 12/2009 | Laws et al. | |
| 7,850,148 | B2 * | 12/2010 | Collins, IV | 256/65.14 |

(Continued)

*Primary Examiner* — Victor MacArthur

(74) *Attorney, Agent, or Firm* — Scully, Scott, Murphy & Presser, P.C.

(57) ABSTRACT

A fence system for strengthening a vinyl fence which includes a plurality of fence posts having specified dimensions, and the posts have a hollow interior. A plurality of section panels include specified dimensions, and the section panels each including a slat portion. The section panels each include a fence railing coupled to a top and bottom of the slat portion. The fence railings each define a hollow interior, and the fence railings are coupled to the posts by a connecting portion of the fence railings passing through corresponding holes in the posts. A strengthening member for positioning in each of the hollow portions of the top and bottom fence railings. A plurality of post members for positioning within the hollow interior at the top of the fence posts. The post members being attachable to the connecting portion of the fence railing using a first attachment element.

5 Claims, 5 Drawing Sheets

(56) References Cited

U.S. PATENT DOCUMENTS

| | | | | |
|---|---|---|---|---|
| 2001/0005010 | A1 | 6/2001 | Larsen et al. | |
| 2001/0025953 | A1 | 10/2001 | Shepherd | |
| 2002/0088968 | A1 | 7/2002 | Bebendorf | |
| 2002/0125469 | A1 | 9/2002 | Jones | |
| 2002/0162994 | A1 | 11/2002 | Langlie et al. | |
| 2003/0030047 | A1 | 2/2003 | Ohanesian | |
| 2003/0222253 | A1 | 12/2003 | Langlie et al. | |
| 2004/0140462 | A1 | 7/2004 | Rowley et al. | |
| 2005/0269558 | A1* | 12/2005 | Keefe | 256/64 |
| 2006/0131552 | A1 | 6/2006 | Rowley et al. | |
| 2006/0202186 | A1 | 9/2006 | Rowley et al. | |
| 2007/0090334 | A1* | 4/2007 | Laws et al. | 256/24 |
| 2007/0158629 | A1* | 7/2007 | Laws et al. | 256/24 |
| 2009/0078923 | A1* | 3/2009 | McGinness et al. | 256/65.01 |
| 2009/0134377 | A1* | 5/2009 | Petta et al. | 256/65.01 |
| 2009/0166598 | A1 | 7/2009 | Heinz | |
| 2009/0194754 | A1* | 8/2009 | Timothy | 256/31 |
| 2009/0200531 | A1 | 8/2009 | Rowley et al. | |
| 2009/0224222 | A1* | 9/2009 | Dezen et al. | 256/59 |
| 2012/0319067 | A1* | 12/2012 | Millar et al. | 256/19 |

* cited by examiner

SYSTEM AND FENCE KIT FOR STRENGTHENING A FENCE

FIELD OF THE INVENTION

The present invention generally relates to a fence kit and method for strengthening a fence, and more specifically, the present invention relates to a fence kit and method for strengthening a fence for sustaining a specified wind velocity.

BACKGROUND OF THE INVENTION

Fences are commonly used to delineate borders between properties, such as between residential homes or lots, or commercial properties. Typical types and materials used for fencing may include vinyl, chain link, wood, or stone or brick.

Chain link fences have considerable strength but are considered by many to be aesthetically unattractive and may be easily damaged. Wood fences are considered by many to be more attractive than chain link. However, wood can quickly deteriorate from exposure to the weather, and consequently, wood fences are considered by many to be high maintenance. Vinyl fences, such as Polyvinyl Chloride (PVC), are preferred as requiring less maintenance than wood fences and more aesthetically pleasing than other types of fencing. However, vinyl fencing can be weak, especially regarding susceptibility to wind damage. Additionally, damaged vinyl fencing is not easily repaired or replaced, and often requires removal and replacement of fence posts to repair even a single slat.

It would therefore be desirable to provide a strengthened vinyl fence for longevity of the fence and being able to sustain wind challenges. It would further be desirable to provide a method and/or kit for strengthening existing vinyl fences, in one instance after construction of the fence. It would also be desirable to provide a method and/or kit for strengthening a fence, before construction, which is delivered in stock form, for strengthening the fence to sustain a specified wind velocity over a period of time.

SUMMARY OF THE INVENTION

In an aspect of the invention, a method for strengthening a vinyl fence comprises: providing a plurality of fence posts having specified dimensions, the posts defining a hollow interior; providing a plurality of section panels including specified dimensions, the plurality of section panels each including a slat portion, and the plurality of section panels each including a fence railing coupled to a top and bottom of the slat portion, the fence railings each defining a hollow interior; positioning at least one strengthening member in each of the hollow portions of the top and bottom fence railings; coupling the fence railings to the posts by a connecting portion of the fence railings passing through corresponding holes in the posts which are defined by the posts; positioning a plurality of post members within the hollow interior of a top of the fence posts; attaching the post members to the connecting portion of the fence railing using a first attachment element having specified dimensions; coupling the bottom fence railing to a bottom portion of the post using a second attachment element having specified dimensions; and coupling the top and bottom fence railings to the strengthening members using a plurality of third attachment elements having specified dimensions.

BRIEF DESCRIPTION OF THE DRAWINGS

These and other objects, features and advantages of the present invention will become apparent from the following detailed description of illustrative embodiments thereof, which is to be read in connection with the accompanying drawings. The various features of the drawings are not to scale as the illustrations are for clarity in facilitating one skilled in the art in understanding the invention in conjunction with the detailed description. In the drawings.

DETAILED DESCRIPTION OF THE INVENTION

A method and system for strengthening a vinyl fence according to an embodiment of the invention includes a number of posts, railings and section panels for completing a specified length of fence. The posts, railings and section panels may be a standard fencing assembly. In the method and system of the present invention, the standard fence assembly will be strengthened to withstand a sustained wind velocity. For example, a maximum wind velocity of 75 mph over a period of time, such as is the standard for fencing in Miami-Dade County of Florida to withstand hurricane force winds. One example, of an embodiment of a fence product using the method of the present invention includes the: "Grand Illusions Series™" by Illusions Vinyl Fence™.

Figure 1:
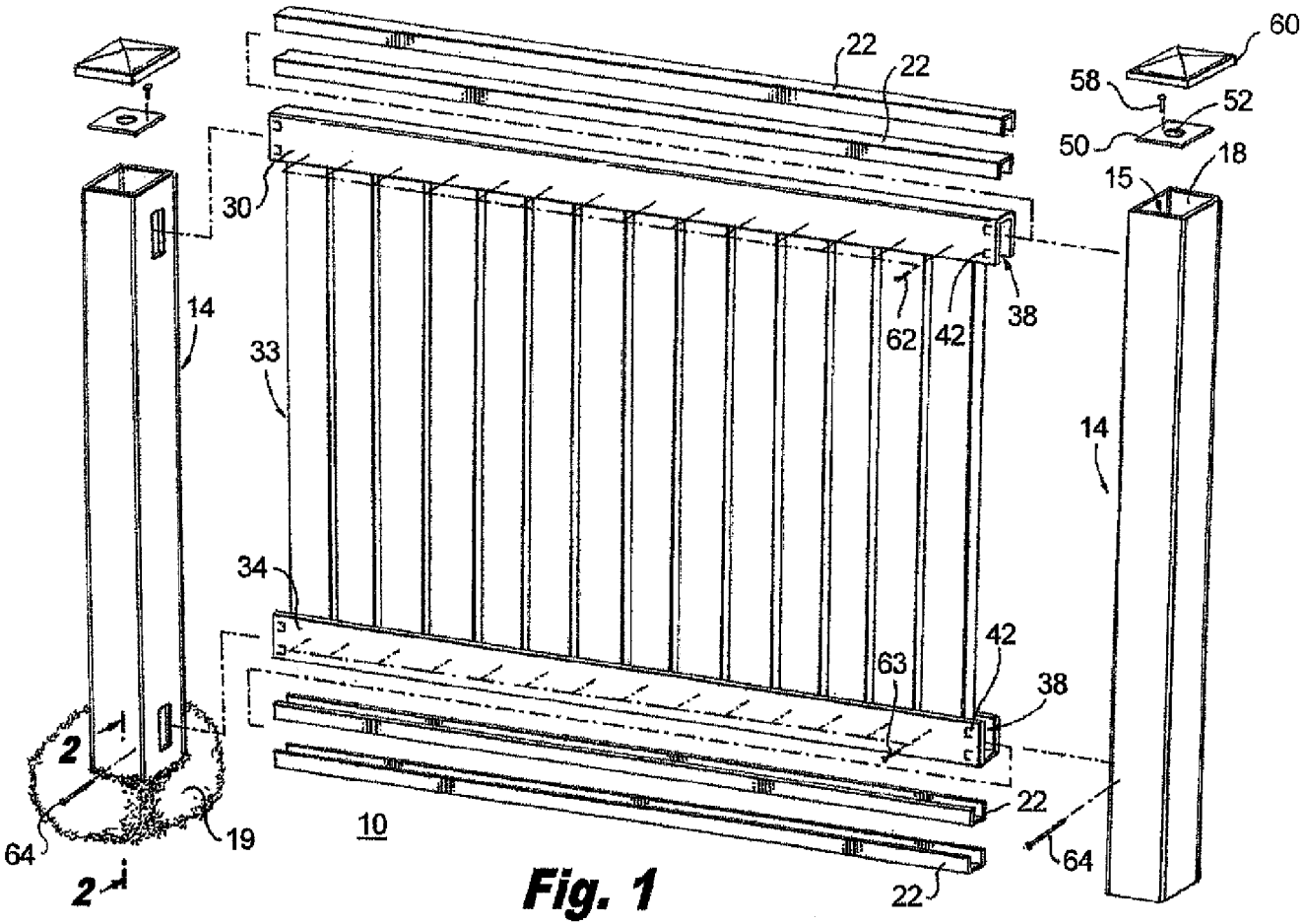
FIG. 1 is an isometric view of an assembly depicting a system and method of the invention according to one embodiment of the invention for strengthening a vinyl fence.
Figure 2:
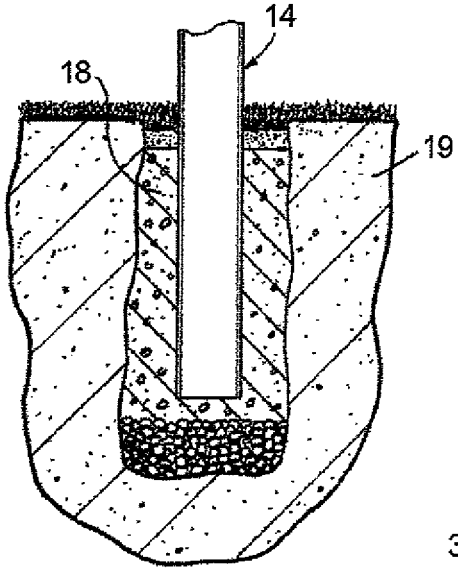
FIG. 2 is a side elevational cut away view of a fence post in the ground.

Referring to FIG. 1, in an embodiment of a method and system according to the present invention, a fence system 10 includes at least heavy duty posts 14 having about a 5 inch by 5 inch cross section. Another example includes heavy duty posts having about an 8 inch by 8 inch cross section. The wall thickness of either post dimension is about 0.250 inches. Corner posts can be longer than section posts. Many types of section panels having slats 33 may be used with the heavy duty posts 14. After stringing lines to ensure a straight fence installation, holes are dug in the ground 19 for installation of the posts 14, as shown in FIG. 2. A hole filled with cement 18 is shown in FIG. 2. The holes should be as deep as the post above ground. For example, no less than 30 inches below grade for a 5 in by 5 in post, and no less than 42 inches for the 5 in by 8 in posts. The diameter of the holes should be no less than 12 inches for the 5 in by 5 in posts and 15 inches for the 8 in by 8 in posts. A premium wet or dry concrete mix is used depending on ground conditions in the area of fencing.

Figure 3:
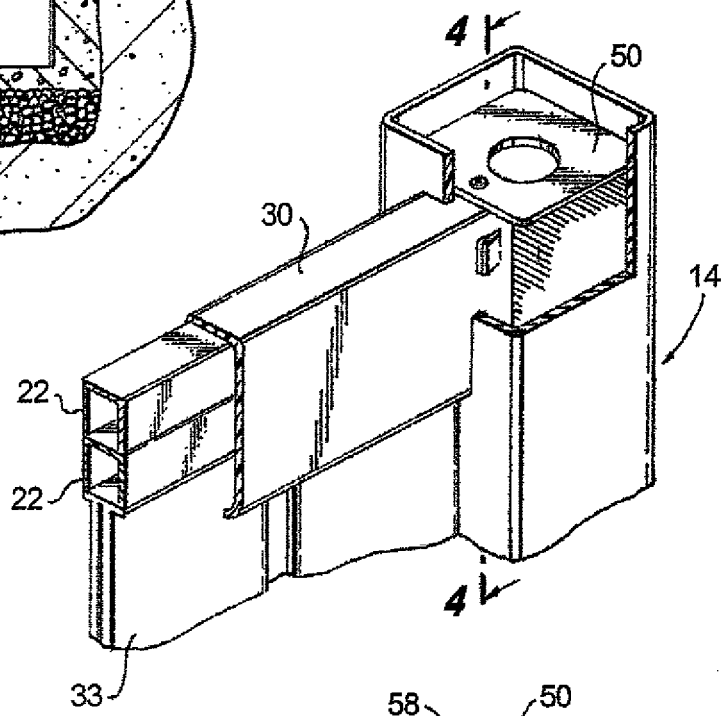
FIG. 3 is an isometric view of the post and strengthened railing coupled together.
Figure 4:
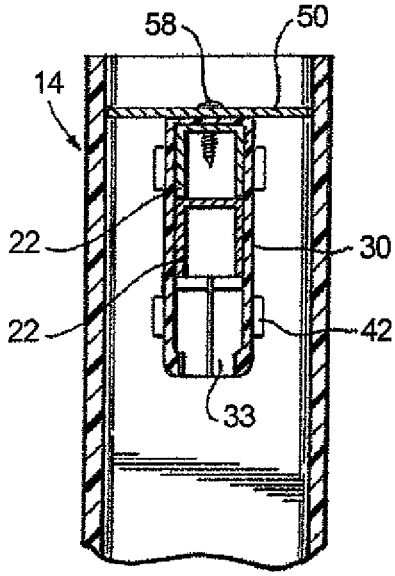
FIG. 4 is a cross sectional view along line 2-2 of FIG. 1.
Figure 5:
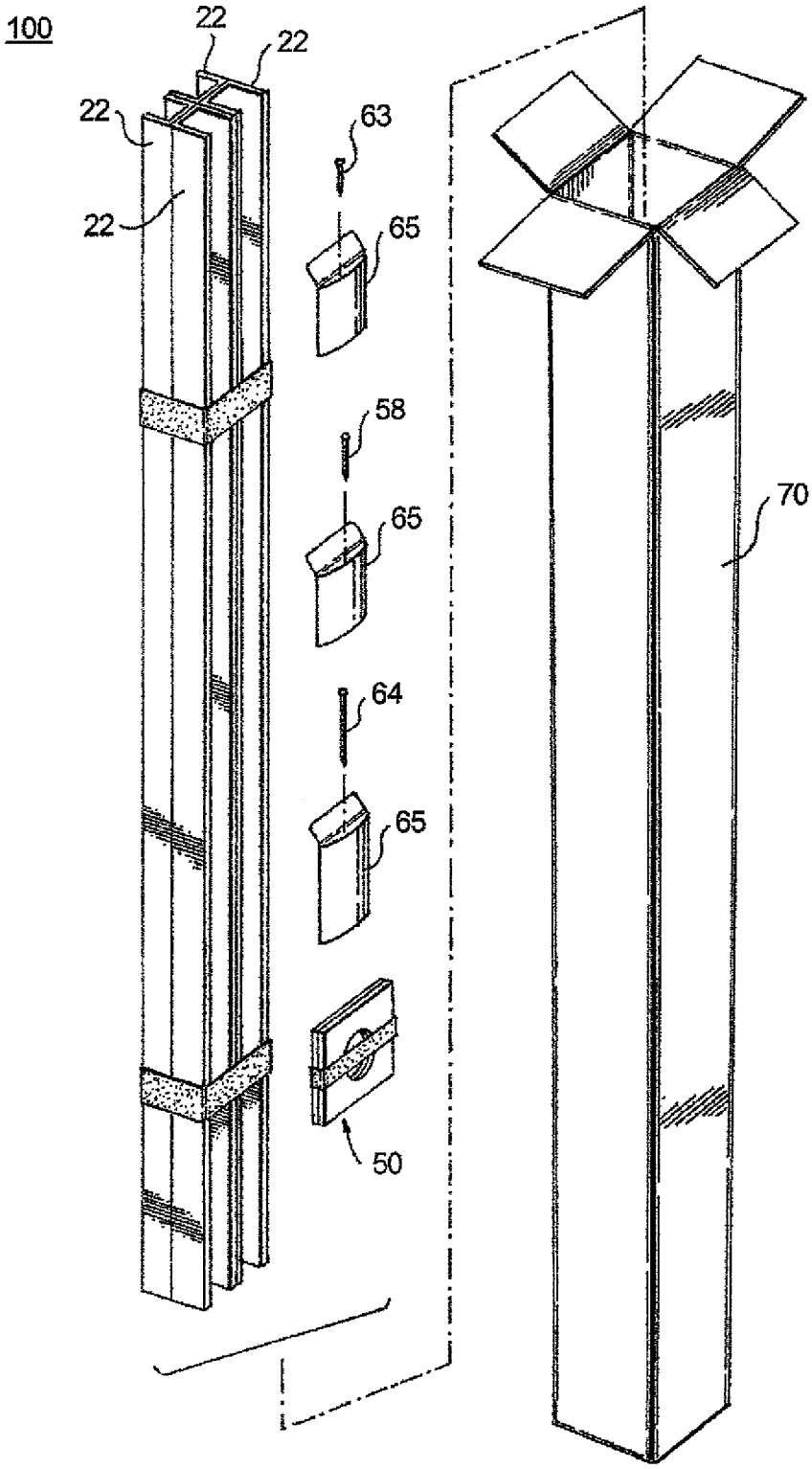
FIG. 5 is an isometric view of an assembly of a kit according to an embodiment of the invention.
Figure 6:
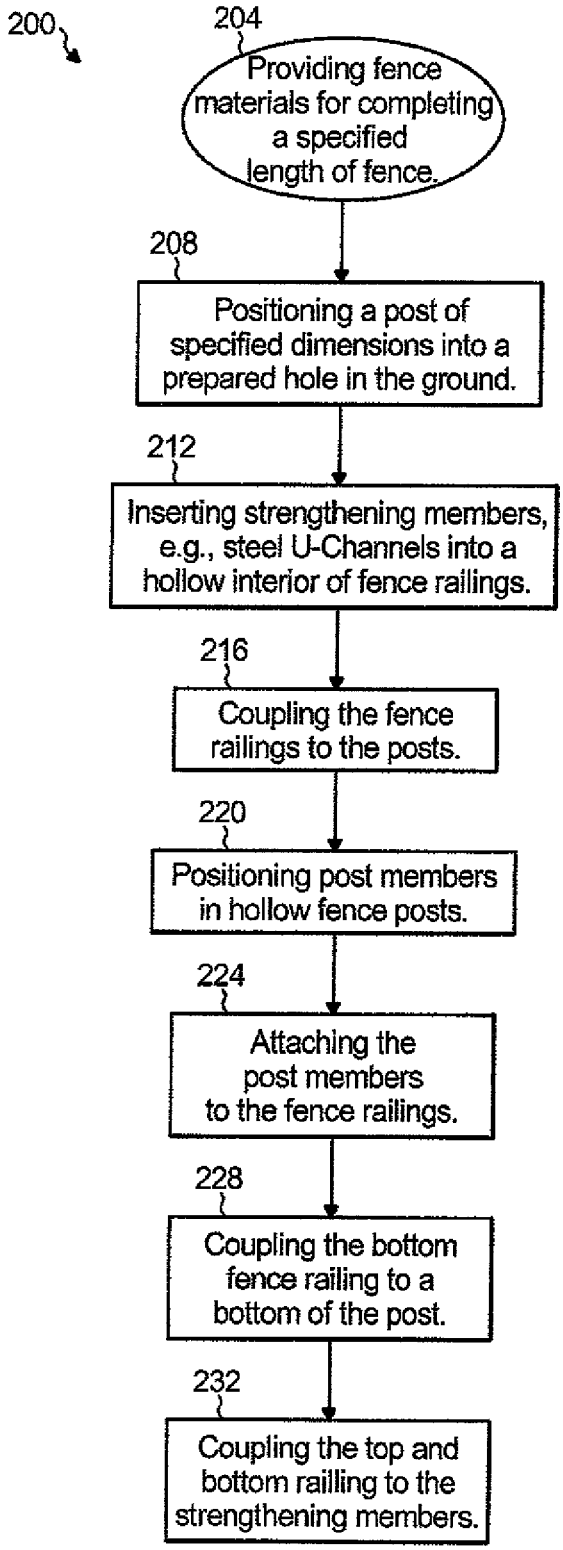
FIG. 6 is a flow chart according to a method of the invention.

Two steel U-channels 22 are inserted in the hollow portions 38 of the top railing 30 and bottom railing 34 as also shown in FIG. 3. One or more U-channels are an embodiment of strengthening members for insertion into the hollow portions of the top and bottom railings. The U-channels provide support to the top and bottom railings and the entire fence for sustaining sustained 75 mph winds.

In the present embodiment of the invention two U-channels 22 are inserted in the top and bottom section railings. Other fence types may require different numbers of U-channels to meet the wind standards, which require the rigidity of the fence be able to sustain specified continuous wind velocities. For example, one U-channel may be used in the top railing and two in the bottom railing. Further, three U-channels may be used in the top and bottom railings. The U-channel may be galvanized steel. Also, for example, the gauge of U-channel steel may vary. Other shapes for strengthening members may be used other than U-channel, as well as other materials for strengthening members, such as aluminum.

The railings are attached to the posts, which may be by snapping in using a pre-notched 42 portion of the railings being pre-assembled to section panel such that the pre-notched portion of the railing is inserted into the post.

Screws used in the embodiment of the present invention described herein are embodiments of attachment elements, i.e., first, second, and third attachment elements. A post member embodied as a donut 50 is inserted into the top area of each of the posts 14. The donut 50 is shaped as a square with a circular hole 52 in the center of the donut 50. For example, the donut 50 may be about 5 in by 5 in, or about 8 in by 8 in, to fit in the hollow interior 15 of a corresponding post of the similar dimensions. Alternatively, the donut may be other shapes that fit into the hollow post, such as, rectangular, oval, or circular.

The donuts 50 are secured in the top area of the posts 14 using at least one screw 58 passing through the donut 50 into a portion of the railing 14 and the U-channels 22 which extends into the post 14. Two screws 58 may be used per fence section where the screws are 1 inch in length, when using posts having cross-section dimensions of 5 in by 5 in, or 8 in by 8 in dimensions. The donut 50 is positioned in the hollow interior 15 of the post 14 and thus is adjacent the interior walls 15 of the post 14. Once secured in position, the donut 50 provides additional stiffening to the post 14, and the connection between the post 14 and top fence railing 30. Any torsional or directional forces caused by the velocity of the wind are resisted by the donut 50, post 14, and top railing 30 arrangement, thereby providing rigidity to the fence. For example, wind velocities causing sway of the post or torsion of the fence will be discouraged from bending, twisting or toppling the fence because the donut 50 will receive some of the force via the donut and post 14 as the donut 50 pushes up against the post 14, thereby stabilizing the fence assembly by stabilizing the posts 14 and top railing 30, as well as the bottom railing 34 being strengthened by the U-channels 22.

Figure 8:
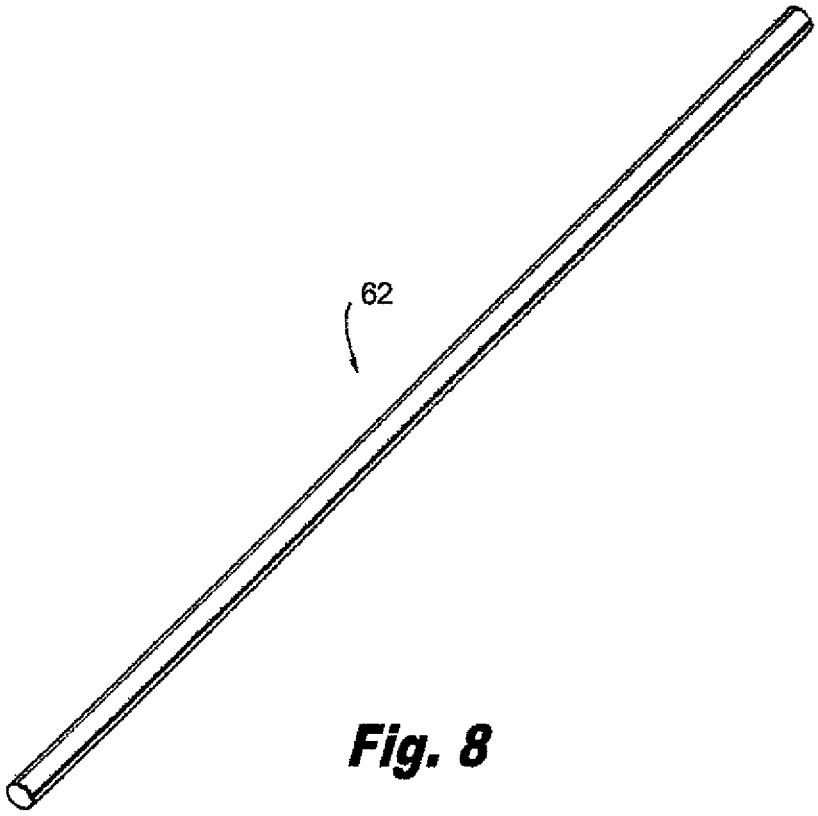
FIG. 8 is an isometric view of a rod for use with an embodiment of the invention.

Additionally, a steel rod 62 (FIG. 8) may be passed through the center hole 52 of the donut 50, through the hollow interior 15 of the post 14 and into the ground 19 or cement 18. In this configuration, the steel rod 62 provides further stability to the post 14 and connected top fence railing 30. For example, wind velocities causing sway of the post or torsion of the fence will be discouraged from bending, twisting or toppling the fence because the steel rod 62 will receive some of the force via the donut and post as the donut pushes up against the steel rod, thereby stabilizing the fence by stabilizing the post and top railing 30, as well as the bottom railing 30. In other embodiments of the invention, the rod may not be included in the fence system.

For the bottom of the posts adjacent the ground, a screw 64 is passed through the fence post 14 and a U-channel 22 to further stabilize the fence section panels and the entire fence. For example, four screws per fence section may be used to attach the fence post to the U-channel where the screws are 3 inches long when using 5 in by 5 in posts, and the screws are 4 inches long for 8 in by 8 in posts.

A plurality of attachment members embodied as screws 63 are used to secure the top and bottom fence railings 30, 34 to the U-channels 22. For example, the screws 63 can be equally spaced along each of the top and bottom railings. For example, 30 ¼ in long screws per fence section can be used when using 5 in by 5 in posts. In another example, 60 ¾ in long screws per fence section can be used when using 8 in by 8 in posts. Other attachment elements may be used to secure the donut to the railing, the fence post to the U-channel, and the railings to the U-channels.

Further, post caps 60 are glued on the top of the posts 14 to discourage water from entering the posts and for aesthetic reasons.

Figure 7:
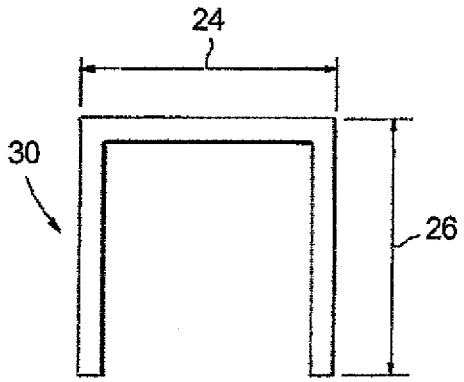
FIG. 7 is an end view of a U-channel strengthening member.

The U-channels 22 may be G60 galvanized steel which is 20 gauge steel, and may have a thickness in the range of 0.036 in to 0.042 inches. Further, the web width 24 and leg length 26 of the U-Channel may be specified dimensions (as shown in FIG. 7) for fitting within the railing. The Steel U-channels may be galvanized steel. Other cross sectional steel may be used, such as, C-Channels, or steel rods.

One advantage of the strengthening members including the U-channel is the resulting stiffening versus the weight of the strengthening member provides the stiffening of the fence to sustain a sustained wind speed of 75 mph without being too heavy for the fence railing and fence slat structure to hold the strengthening member without warping, cracking, or breaking. The strengthening members are strong enough to provide stiffness to the fence, but light enough to avoid bending, buckling, or any other type of over burdening the vinyl fence.

In another embodiment of the invention, the elements described above for strengthening a standardized fence can be packaged as a kit 100 (alternatively referring to as a wind kit). The kit 100 includes a package 70 housing the U-channels 22 for insertion into the hollow interior 38 of the top and bottom railings 30, 34 as shown in FIGS. 1 and 3. Also, included in the kit 100 package 70 are donuts 50, and various quantities of required screws 58, 63, 64, all described above. The rods may not be included in the kit in another embodiment of the invention.

More particularly, the kit 100, for each fence section, the donut 50 for insertion into the hollow interior at the top of each of the posts; the U-Channels 22, and different size screws 58 64, 63, in packages 65 for attaching the donut to the fence railing, the post to the U-channels, and the fence railings to the U-channels, respectively. As described above the donuts 50 are secured in the top of the posts 14 using a screw 58 passing through the donut into a portion of the top railing 30 which extends into the post 14. Further, a screw 64 is passed through the fence post 14 and a U-channel 22 to secure the fence section panel to the bottom of the posts 14 adjacent the ground, thereby further stabilizing the fence.

By applying the kit package to a standard fence purchase, the fence can be modified to provide support to the top and bottom rails and the entire fence for sustaining sustained 75 mph winds, and wind gusts of up to 110 mph. Different kits may be provided for different fencing, such as fencing using 5 in by 5 in posts, or 8 in by 8 in posts. Using the present invention, the entire fence sustains 75 mph winds, and wind gusts of up to 110 mph when using the 5 in by 5 in posts, and sustains 75 mph winds, and wind gusts of up to 130 mph when using 8 in by 8 in posts. Each kit includes the screws, U-channel supports, and donuts, and optionally the rods for each section of fence. For example, one embodiment of a kit includes, for an 8 in by 8 in post fence construction, sixty ¾ in screws, two 1 in screws, four 4 in screws, four galvanized U-channels, and one 8 in by 8 in donut, for each section of fence, being used with posts having 8 in by 8 in cross-sectional dimensions. Thus, the above kit includes two first attachment elements as screws having a 1 inch length; four second attachment elements as screws having a 4 inch length; sixty third attachment elements as screws having a ¼ inch length; and a post member embodied as an 8 in by 8 in donut; and four strengthening members being galvanized steel U-channels.

In another embodiment, a kit includes, for a 5 in by 5 in post fence construction, thirty ¾ in screws, two 1 in screws, four 3 in screws, three galvanized U-channels, and one 5 in by 5 in donut, for each section of fence, for use with posts having 5 in by 5 in cross-sectional dimensions. Thus, the above kit includes two first attachment elements as screws having a 1 inch length; four second attachment elements as screws having a 3 inch length; thirty third attachment elements as screws having a ¾ inch length; and a post member embodied as an 8 in by 8 in donut; and three strengthening members being galvanized steel U-channels.

A method 200 for strengthening a vinyl fence according to an embodiment of the invention, similarly to the system 10 described above, includes in step 204 providing a plurality of fence posts having specified dimensions, and the posts having a hollow interior. Step 204 including providing a plurality of section panels including specified dimensions, the plurality of section panels each including a slat portion 33, and the plurality of section panels each including a fence railing coupled to a top and bottom of the slat portion. The fence railings each define a hollow interior. Positioning a post of specified dimensions into a prepared hole in the ground and optionally setting in cement is included in step 208. In step 212, at least one strengthening member is positioned in each of the hollow portions of the top and bottom fence railings. In step 216, the fence railings are coupled to the posts by a connecting portion of the fence railings passing through corresponding holes in the posts which are defined by the posts. Step 220 includes, positioning a plurality of post members within the hollow interior of a top of the fence posts. Step 224 includes, attaching the post members to the connecting portion of the fence railing using a first attachment element having specified dimensions. Step 228 includes, coupling the bottom fence railing to a bottom portion of the post using a second attachment element having specified dimensions. Step 232 includes, coupling the top and bottom fence railings to the strengthening members using a plurality of third attachment elements having specified dimensions. The method above enables the fence assembly withstand a sustained wind speed, such as a sustained wind speed is at least 75 mph or less.

While the present invention has been particularly shown and described with respect to preferred embodiments thereof, it will be understood by those skilled in the art that changes in forms and details may be made without departing from the spirit and scope of the present application. It is therefore intended that the present invention not be limited to the exact forms and details described and illustrated herein, but falls within the scope of the appended claims.

What is claimed is:

1. A system for strengthening a vinyl fence, comprising:

a first post and a second post distanced from each other, each post having predetermined dimensions, each post defining a hollow interior having a first shape, the first post having a first top side opening and a first bottom side opening, the second post having a second top side opening and a second bottom side opening, the first top side opening and the second top side opening longitudinally facing each other, the first bottom side opening and the second bottom side opening longitudinally facing each other;

a plurality of slats disposed side by side to each other and collectively provided between the first post and the second post, each slat comprising a top portion and a bottom portion;

a hollow top railing for collectively receiving the top portions of the plurality of slats, the hollow top railing comprising a first end adapted to be inserted into the first top side opening of the first post to be disposed within the hollow interior of the first post and a second end adapted to be inserted into the second top side opening of the second post to be disposed within the hollow interior of the second post;

a first U-shaped strengthening member extending longitudinally in the hollow top railing, the first U-shaped strengthening member comprising a first end adapted to be inserted into the first top side opening of the first post to be disposed within the hollow interior of the first post and a second end adapted to be inserted into the second top side opening of the second post to be disposed within the hollow interior of the second post;

a hollow bottom railing for collectively receiving the bottom portions of the plurality of slats, the hollow bottom railing comprising a first end adapted to be inserted into the first bottom side opening of the first post to be disposed within the hollow interior of the first post and a second end adapted to be inserted into the second bottom side opening of the second post to be disposed within the hollow interior of the second post;

a second U-shaped strengthening member extending longitudinally in the hollow bottom railing, the second U-shaped strengthening member comprising a first end adapted to be inserted into the first bottom side opening of the first post to be disposed within the hollow interior of the first post and a second end adapted to be inserted into the second bottom side opening of the second post to be disposed within the hollow interior of the second post;

a first post member disposed in the hollow interior of the first post and having a second shape complementary to the first shape of the hollow interior, the first post member having a central hole, wherein after the first end of the top railing and the first end of the first U-shaped strengthening member are inserted into the first top side opening of the first post, the first post member is provided on top of the top railing and a first screw extends through the first post member, the top railing and the first U-shaped strengthening member to provide fixation thereof; and a first rod extending through the center hole of the first post member from the top to the bottom of the first post.

2. The system of claim 1, further comprising:

a second post member disposed in the hollow interior of the second post and having the second shape complementary to the first shape of the hollow interior, the second post member having a central hole, wherein after the second end of the top railing and the second end of the first U-shaped strengthening member are inserted into the second top side opening of the second post, the second post member is provided on top of the top railing and a second screw extends through the second post member, the top railing and the first U-shaped strengthening member to provide fixation thereof; and a second rod extending through the center hole of the second post member from the top to the bottom of the second post.

3. The system of claim 1, wherein the first strengthening member and the second strengthening member are comprised of galvanized steel.

4. The system of claim 1, further including a first post cap glued to the top of the first post and a second post cap glued to the top of the second post.

5. A kit for strengthening a vinyl fence, comprising:

a system for strengthening a vinyl fence according to claim 1; and a package for containing the system.

* * * * *